US006626804B2

(12) United States Patent
Wang et al.

(10) Patent No.: US 6,626,804 B2
(45) Date of Patent: Sep. 30, 2003

(54) WORK-INDICATING UNIT OF A MAGNETIC CONTROL EXERCISE APPARATUS

(76) Inventors: Leao Wang, No.1, Lane 233, Sec.2, Charng Long Rd., Taiping (TW), 406; Peter Wu, No.1, Lane 233, Sec.2, Charng Long Rd., Taiping (TW), 406

( * ) Notice: Subject to any disclaimer, the term of this patent is extended or adjusted under 35 U.S.C. 154(b) by 168 days.

(21) Appl. No.: 09/881,219

(22) Filed: Jun. 15, 2001

(65) Prior Publication Data

US 2002/0193207 A1 Dec. 19, 2002

(51) Int. Cl.[7] ..... A63B 69/16; A61B 5/22
(52) U.S. Cl. ..... 482/63; 73/379.01
(58) Field of Search ..... 482/51, 57–63, 482/8, 900–903; 73/379.01, 379.07, 1.11, 1.08

(56) References Cited

U.S. PATENT DOCUMENTS 3,580,083 A * 5/1971 Zipser ..... 324/613
3,643,943 A * 2/1972 Erwin et al. ..... 482/8
3,767,195 A * 10/1973 Dimick ..... 482/5
4,625,551 A * 12/1986 Carnielli ..... 73/379.07

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a work-indicating unit of a magnetic control exercise apparatus. A plurality of circuit board sets are positioned around a flywheel. Each circuit board set has several sensing elements and light-emitting elements (e.g. monochromatic or polychrome LED). Each sensing element corresponds to a magnet set of the magnetic resistance elements in order to detect the resistance voltage value produced by the flywheel in unit time. The resistance voltage is used to actuate the light-emitting elements. Accordingly, the amount of exercise in unit time is displayed by the light-emitting elements, which are lit or not lit depending on the amount of resistance voltage.

6 Claims, 3 Drawing Sheets

WORK-INDICATING UNIT OF A MAGNETIC CONTROL EXERCISE APPARATUS

BACKGROUND OF THE INVENTION

1. Field of the Invention

The present invention relates to a work-indicating unit of a magnetic control exercise apparatus, and more particularly, to indicators powered by the voltage produced during the motion of the exercise apparatus. In cooperation with a circuit board and sensing elements, the light-emitting elements are controlled and turned on or off.

2. Description of the Prior Art

A magnetic control exercise apparatus is an exercise apparatus (e.g. exercise bike, rowing exercise apparatus, treadmill, etc.) which makes use of the magnetic resistance elements in cooperation of the rotation of the flywheel to control the exercise resistance. In operation, when the pedals 11 are treaded, the pedal wheel 12 is rotated to bring a chain wheel 14 in motion by means of a chain 13. A unidirectionally driven flywheel 16 is coaxially fitted beside the chain wheel 14 on axle 15. Accordingly, the flywheel 16 rotates with the chain wheel 14 due to the coaxial arrangement. Thereafter, the flywheel 16 has an adjustable magnetic resistance element 18 with magnet sets 17. A proper resistance is created by adjusting the clearance between the magnetic resistance elements 18 and the flywheel 16. At the same rotational speed, increasing the clearance between the flywheel and the magnetic resistance elements reduces the exercise resistance (amount of exercise or work).

The conventional product to indicate the amount of exercise is fitted with a, detecting device (not shown). After receipt of a value of amount of exercise (or the voltage value created between the flywheel 16 and the magnet sets 17), the value will be transmitted through wiring to the microprocessor (not shown) of a control panel 19. Then, the value will be converted by the built-in program into the Watt value to show on the control panel 19. However, the Watt value is a professional term that offers normal operators a "value" without significance. Moreover, the trainers in gyms have to look at the console to learn the amount of exercise. It's unpractical for trainers and trainees.

SUMMARY OF THE INVENTION

It is a primary object of the present invention to remove the above-mentioned drawbacks and to provide a work-indicating unit for a magnetic control exercise apparatus in which the voltage created during the exercise session is used to actuate the light-emitting elements such that lights are turned on or off to indicate the work or amount of exercise being performed in unit time and display the information.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
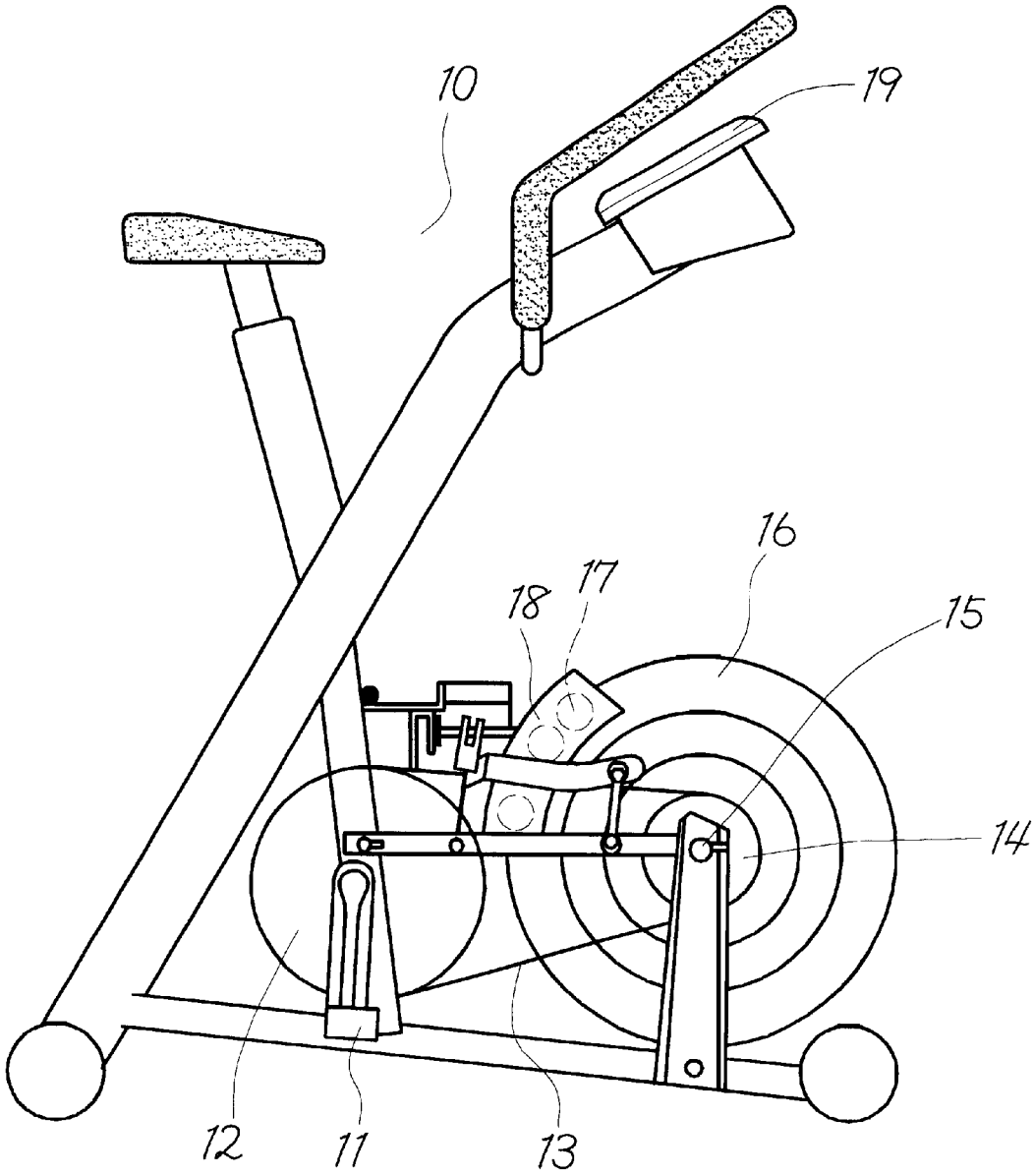
FIG. 1 is a schematic drawing of a magnetic control bike.
Figure 3:
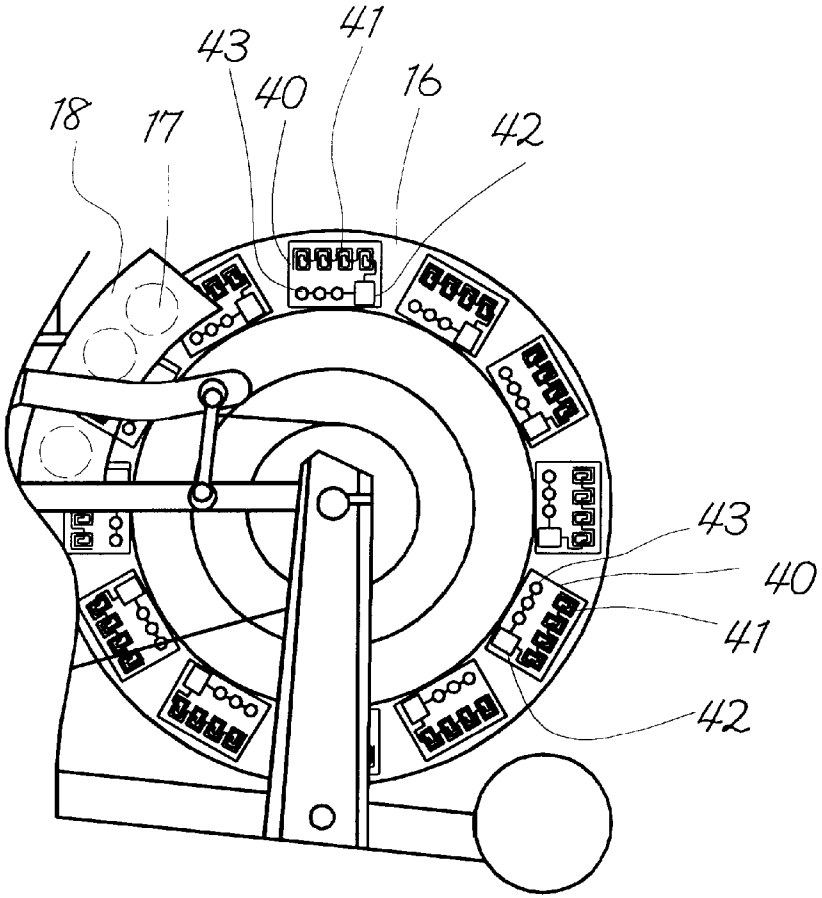
FIG. 3 is a schematic drawing of circuit boards of the present invention.
Figure 2:
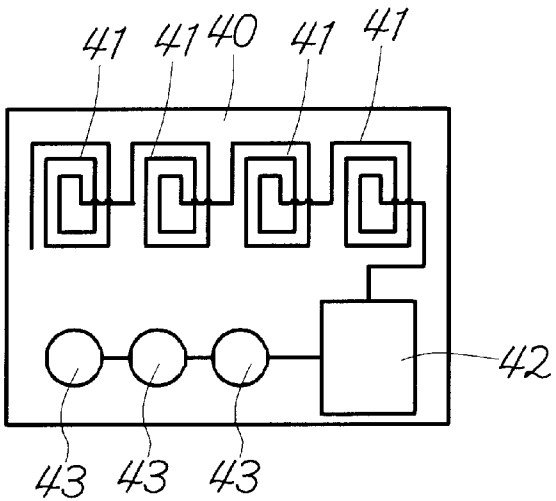
FIG. 2 is a schematic drawing of a preferred embodiment of FIG. 2.

Referring to FIGS. 1 and 2, a preferred embodiment of the exercise bike 10 is shown. A plurality of circuit board sets 40 corresponding to magnetic resistance elements 18 are positioned around a flywheel 16. Each circuit board 40 has several sensing elements 41, an electronic control loop 42, and several light-emitting elements 43. Each sensing element 41 corresponds to a magnet set 17 of the magnetic resistance element 18. The sensing elements 41 detect the resistance voltage value produced by the flywheel 16 in unit time in cooperation with the magnetic resistance elements 18. Thereafter, the resistance voltage is transmitted through the preset wiring to the electronic control loop 42 which is programmed to control the light-emitting elements 43 of certain color. The action of each of the light-emitting elements 43 is powered by the same resistance voltage. Accordingly, the amount of exercise in unit time is transmitted to the electronic control loop 42 such that the light-emitting elements 43 light up or go out.

In other words, the light-emitting elements 43 of different colors light up or go out in accordance with the difference of the measured resistance voltage value by means of the electronic control loop 42 and the built-in program. For example, when the measured resistance voltage value in unit time is within a preset range, a light-emitting element 43 of certain color will be actuated while the others are not actuated. Likewise, each of the circuit board sets 40 immediately actuates the light-emitting element 43 of a different color in accordance with different values of the measured resistance voltage.

Therefore, when the flywheel 16 is forced to rotate, each of the circuit board sets 40 immediately actuates the light-emitting element 43 of certain colors in accordance with preset value so that a bright light ring is created for distinguishing different powers. Moreover, a beautiful brightness is formed in addition to the exercise fun.

In order to reach the brightness of the light-emitting elements 43, a transparent chain cover (not shown) is used to cover the transmission elements and to protect the personal safety and the components. Alternatively, the chain cover can be fitted with openings for reaching the expected goal. This is a simple application principle so that no further descriptions are given.

In fact, the electronic control loop 42 is not absolutely necessary for the circuit board 40. If the circuit board 40 doesn't have the electronic control loop 42, the brightness of the light-emitting elements 43 can be made to correspond to the resistance voltage value so that the expected effect is also reachable.

Figure 5:
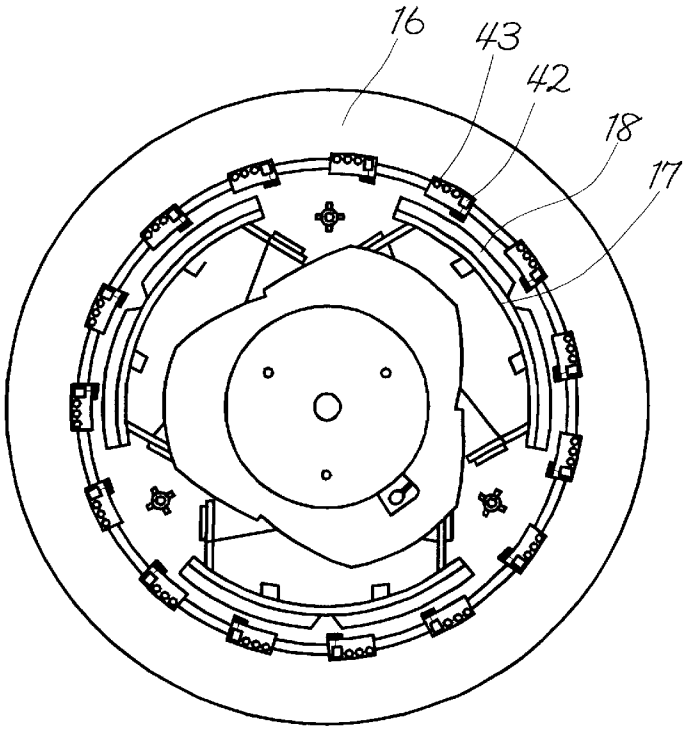
FIG. 5 is a further preferred embodiment of the present invention.
Figure 4:
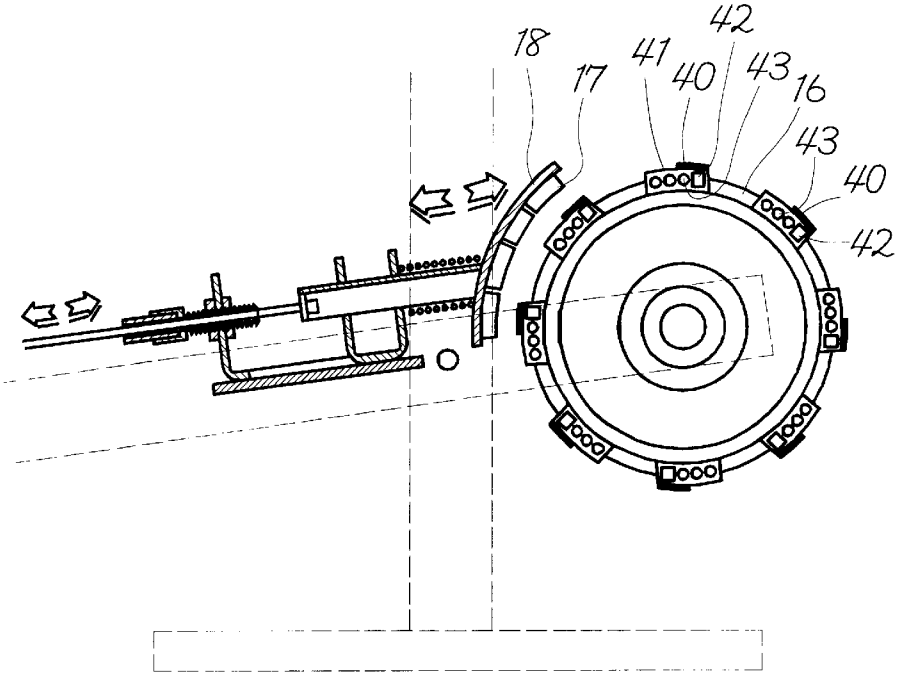
FIG. 4 is another preferred embodiment of the present invention.

Additionally, as shown in FIGS. 4 and 5, the flywheel 16 and the magnetic resistance elements 18 of different exercise apparatuses can be different from that of the present invention. Accordingly, the circuit board 40, the sensing elements 41, the electronic control loop 42 and the light-emitting elements 43 will be changed in shape and position for each new embodiment.

Finally, the present invention can make use of a light coupling or a sensing carbon brush (not shown) to read the measured voltage value. Thereafter, the light-emitting elements 43 are installed at an obvious position of the exercise apparatus (e.g. on the control panel) to reach the same effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A work indicating unit for use with an exercise bike having a movable flywheel, and an adjustable magnetic resistance element with magnet sets and comprising:

a) a plurality of spaced apart circuit board sets mounted on the flywheel, each circuit board set having:

i) a plurality of sensing elements; and ii) a plurality of light-emitting elements, wherein each of the plurality of sensing elements measures a resistance voltage produced between the flywheel and the magnet sets of the magnetic resistance element, such that the resistance voltage is used to control the action of the light-emitting elements.

2. The work indicating unit according to claim 1, wherein each of the circuit board sets include an electronic control loop.

3. The work indicating unit according to claim 1, wherein the light-emitting elements are monochromatic.

4. The work indicating unit according to claim 1, wherein the light-emitting elements are polychromatic.

5. The work indicating unit according to claim 1, further comprising a light sensing coupling brush for reading the measured resistance voltage.

6. The work indicating unit according to claim 1, wherein the light-emitting elements are located on a user-visible display.

* * * * *